US012012187B2

(12) United States Patent
Bass

(10) Patent No.: US 12,012,187 B2
(45) Date of Patent: Jun. 18, 2024

(54) MARITIME OVERBOARD LOCATOR AND RESPONSE SYSTEM

(71) Applicant: The United States of America, as represented by the Secretary of the Navy, Crane, IN (US)

(72) Inventor: Jamie Bass, Evansville, IN (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 534 days.

(21) Appl. No.: 17/205,325

(22) Filed: Mar. 18, 2021

(65) Prior Publication Data

US 2022/0297808 A1 Sep. 22, 2022

(51) Int. Cl.

| | |
|---|---|
| ***B63C 9/00*** | (2006.01) |
| ***B63C 9/01*** | (2006.01) |
| ***B63C 9/04*** | (2006.01) |
| ***B63C 9/08*** | (2006.01) |
| ***B63C 9/26*** | (2006.01) |

(52) U.S. Cl.

CPC ..... *B63C 9/0005* (2013.01); *B63C 9/01* (2013.01); *B63C 9/04* (2013.01); *B63C 9/082* (2013.01); *B63C 9/26* (2013.01); *B63C 2009/042* (2013.01)

(58) Field of Classification Search

None

See application file for complete search history.

(56) References Cited

U.S. PATENT DOCUMENTS

| | | | | |
|---|---|---|---|---|
| 4,305,143 | A | 12/1981 | Simms et al. | |
| 5,463,598 | A | 10/1995 | Holland et al. | |
| 5,886,635 | A | 3/1999 | Landa et al. | |
| 11,440,654 | B2 * | 9/2022 | Tian | B64D 27/24 |
| 2004/0123793 | A1 * | 7/2004 | Jakubowski, Jr. | G08B 5/002 116/210 |
| 2012/0229282 | A1 | 9/2012 | Zagami et al. | |
| 2020/0031438 | A1 * | 1/2020 | Moses | G01S 5/0231 |
| 2022/0284786 | A1 * | 9/2022 | Holmgren | G01S 5/0284 |

FOREIGN PATENT DOCUMENTS

| | | | | |
|---|---|---|---|---|
| CN | 101247740 A | * | 8/2008 | F41H 1/02 |
| WO | WO-2006133212 A2 | * | 12/2006 | B63C 9/0005 |

* cited by examiner

*Primary Examiner* — Adolf Dsouza

(74) *Attorney, Agent, or Firm* — Naval Surface Warfare Center, Crane Division; Christopher Feigenbutz

(57) ABSTRACT

Provided is a maritime overboard locator system for use in locating and rescuing a person or asset that has fallen overboard into a body of water. The system includes a locator attached to a person or asset that is activated manually or automatically upon immersion in water. The apparatus emits light, sound, radio, or any combination thereof. The locator is detected by one or more detectors onboard a boat, ship, vessel, or structure. The detectors detect a unique signal that is assigned to each person/asset. Once detected, the detector sends an overboard alert and deploys an unmanned aerial or underwater drone. The drone can include an inflatable life preserver or life raft and a tether cord that helps the person to remain afloat until rescue can be accomplished.

14 Claims, 3 Drawing Sheets

MARITIME OVERBOARD LOCATOR AND RESPONSE SYSTEM

STATEMENT REGARDING FEDERALLY SPONSORED RESEARCH OR DEVELOPMENT

The invention described herein may be manufactured, used and licensed by or for the United States Government for any governmental purpose without payment of any royalties thereon. This invention (Navy Case 200476US01) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD OF THE INVENTION

The field of invention relates generally to maritime overboard locators. More particularly, it pertains to a maritime overboard locator attached to a sailor's uniform that initiates a distress response from accompanying shipboard systems and deploys an unmanned drone containing rescue equipment.

BACKGROUND

Military, cruise, commercial, and other ships are often several hundred feet in length and are minimally manned. These conditions make it difficult for shipboard personnel to detect an overboard event, which, depending on how much time has elapsed, can also make it difficult to respond. Detection and response times are often critical to the survival of the person/asset overboard. Additionally, sailor uniforms blend with the ocean, making them difficult to spot, which is further complicated by weather conditions that often reduce visibility. Furthermore, if a ship is dealing with an emergency, it may not have the manpower or the equipment to perform an immediate search and rescue operation. As can be appreciated, time is of critical importance in many incidents due to the overboard person enduring cold water temperatures and fatigue.

SUMMARY OF THE INVENTION

The present invention relates to a maritime overboard locator system for use in locating and rescuing a person or asset that has fallen overboard from a vessel or other structure into a body of water. The system includes a locator attached to a person or asset that is activated manually or automatically upon immersion in water. The apparatus emits light, sound, radio, or any combination thereof. The locator is detected by one or more detectors located at various points onboard a boat, ship, vessel, or structure that are tuned to receive/monitor for incoming overboard distress signals. The detectors detect a unique firmware serial number contained in the locator that is assigned to each person/asset. Once detected, the detector transmits the data to the responsible party and deploys an automated tracking system, such as an unmanned aerial or underwater drone. The drone can optionally include an inflatable life preserver or an inflatable life raft and a tether cord that is deployed to the person as it locates and hovers over the overboard person, which aids in confirming the location thereof while helping the person to remain afloat until rescue can be accomplished.

According to an illustrative embodiment of the present disclosure, it is an object of the invention to provide a maritime overboard locator system that broadcasts the approximate location of a person or object that has fallen overboard into a body of water.

According to a further illustrative embodiment of the present disclosure, it is an object of the invention to provide a maritime overboard locator system that includes a transmitter attached to a person/asset that is activated manually or automatically upon immersion in water.

According to a yet another illustrative embodiment of the present disclosure, it is an object of the invention to provide a maritime overboard locator system that detects a unique firmware serial number contained in the locator that is assigned to each person/asset, transmits the data to a responsible party, and deploys an automated tracking system, such as an aerial and/or underwater drone.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
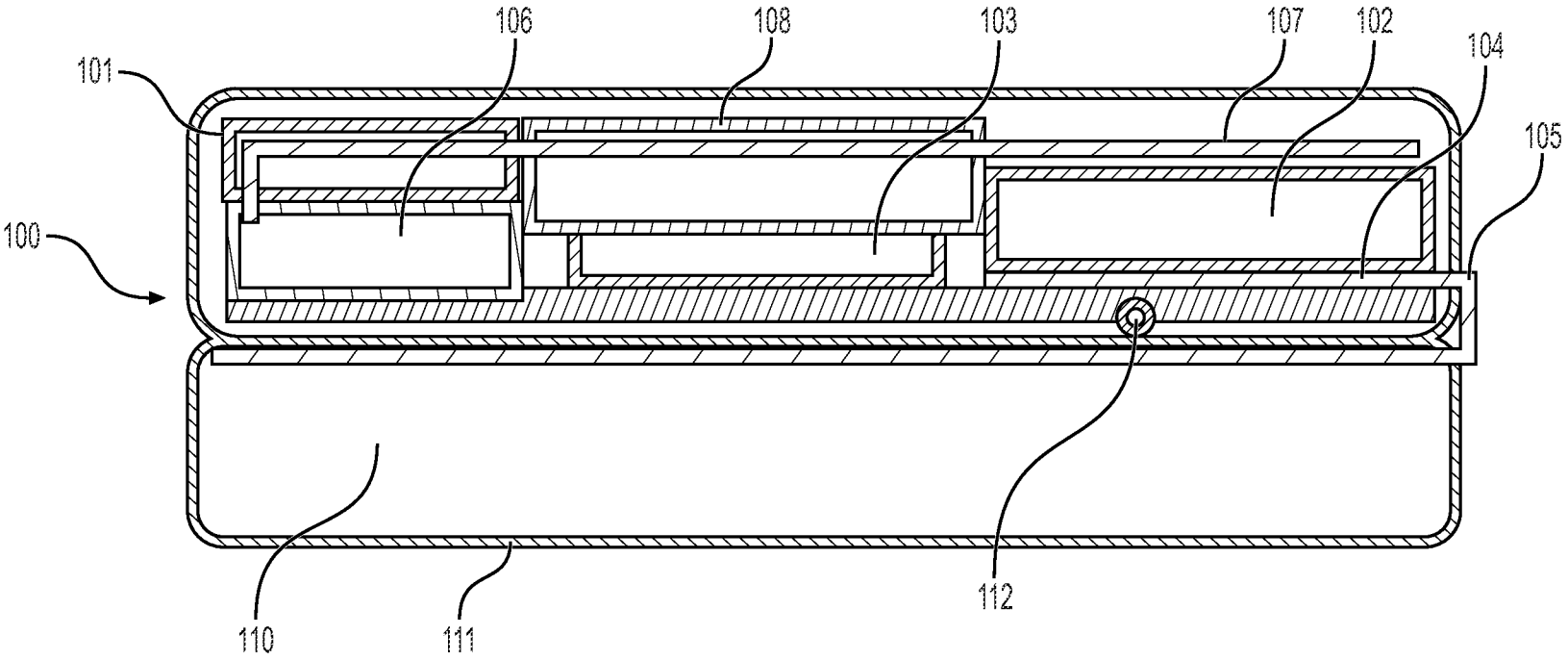
FIG. 1 shows a diagram of the overboard locator.

FIG. 1 shows a diagram of the overboard locator 100. For military purposes, the device can be issued to each sailor to wear on his/her uniform. As can be appreciated, sailor uniforms have epaulette rank button-down straps. The locator 100 can be designed to attach to the sailor on the button-down strap. Alternatively, a larger belt loop version can be utilized for civilians who do not have epaulettes. The components of the locator 100 include a Light Emitting Diode (LED) 101, a power source, such as a battery 102, and a microprocessor 103. All components are mounted to a circuit board 104 and housed in a case 111. The case 111 functions as an epaulette ring for attachment to the button-down straps. The microprocessor 103 has an ID code (serial number) embedded in the firmware, and causes the LED 101 to flash in a certain pattern that reflects that serial number ID code. The purpose for the ordered flashing pattern is to identify the person/asset that has fallen overboard from a distance. The serial number is assigned to the person/asset beforehand, and is recorded to identify the person/asset.

The LED 101 and microprocessor 103 are activated by either pulling the pull tab 105 (which allows the battery 102 to come in contact with the circuit board 104), or by saltwater activation through the galvanic activation switch 112. In addition to the LED 101 operation, a fully functioning unit includes a radio transmitter 106, which, once activated by either pulling the pull tab 105 or by saltwater activation through the galvanic activation switch 112 also intermittently pulse transmits through an RF Antenna 107 the serial number programmed into the microprocessor 103 at a predetermined 'distress' frequency. Detection of this signal triggers a response from the system to deploy rescue equipment, which is discussed further detail below. The pulsing action of the radio transmitter 106 provides a higher power and lower duration signal to conserve battery life. The locator 100 can also include an ultrasonic piezoelectric speaker 108, which, once activated by either pulling the pull tab 105 or by saltwater activation through the galvanic activation switch 112, also intermittently pulse transmits the serial number programmed into the microprocessor 103 at a predetermined ultrasonic 'distress' frequency. The ultrasonic piezoelectric speaker signal can also be used to trigger a response from the system to deploy rescue equipment. The pulsing action of the ultrasonic piezoelectric speaker 108 provides a higher power and lower duration signal to conserve battery life.

It should be noted that not all components described herein are required for the locator 100 to function. A non-limiting list of possible configurations includes:

1. LED, microchip, battery, pull tab and/or galvanic activation switch, case.
2. Ultrasonic piezoelectric speaker, microchip, battery, pull tab and/or galvanic activation switch, case.
3. Radio transmitter, antenna, battery, pull tab and/or galvanic activation switch, case.
4. LED, ultrasonic transmitter, battery, pull tab and/or galvanic activation switch, case.
5. Radio transmitter, antenna, LED, microchip, battery, pull tab and/or galvanic activation switch, case.
6. Radio transmitter, antenna, ultrasonic transmitter, microchip, battery, pull tab and/or galvanic activation switch, case.

Figure 2:
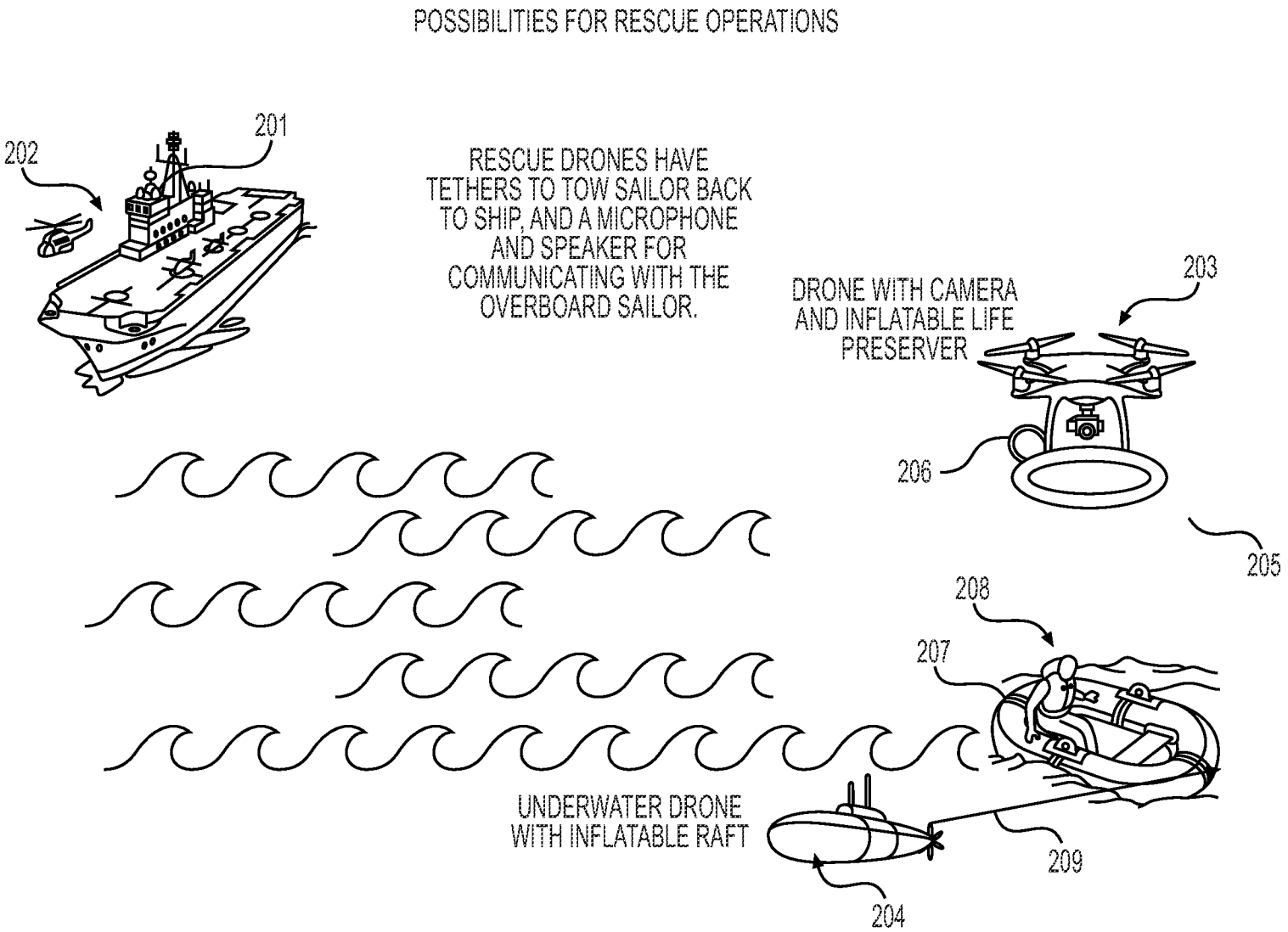
FIG. 2 shows a view of a rescue operation example in response to a detected overboard distress signal.

FIG. 2 shows a view of a rescue operation in response to a detected overboard distress signal. One or more detector units 201 are located onboard a boat, ship, structure, or as shown, a vessel 202. The detector units 201 are specifically tuned to receive distress signals from overboard sensors as described above. When a distress signal is detected, the detector units 201 identify the firmware serial number in the microchip, provide an overboard alert, and automatically deploy one or more aerial drones 203 and/or underwater drones 204 that will move forth and search out the overboard person/asset. In one embodiment, the detector units 201 relay distress information to the aerial drone 203 and/or the underwater drone 204. In another embodiment, the aerial drone 203 and/or the underwater drone 204 receive a signal from the location sensors on the person/asset. Once the overboard person/asset location is identified, the aerial drone 204 may drop an inflatable life preserver 205, which will provide flotation capability for the overboard person/asset. A tether cord 206 can be attached from the drone to the inflatable life preserver 205 in order to tow the overboard person/asset toward the vessel 202 or rescue team.

If an underwater drone 204, is used, the device hones in on the distress signal in order to locate the overboard person/asset. Once located, the underwater drone 204 can deploy an inflatable life raft 207 that will provide flotation capability for the overboard person/asset 208. The inflatable life raft 207 can be tethered by a tether rope 209 to the underwater drone 204, which can then be used to tow the overboard person/asset 208 toward the vessel 202 or rescue team.

Figure 3:
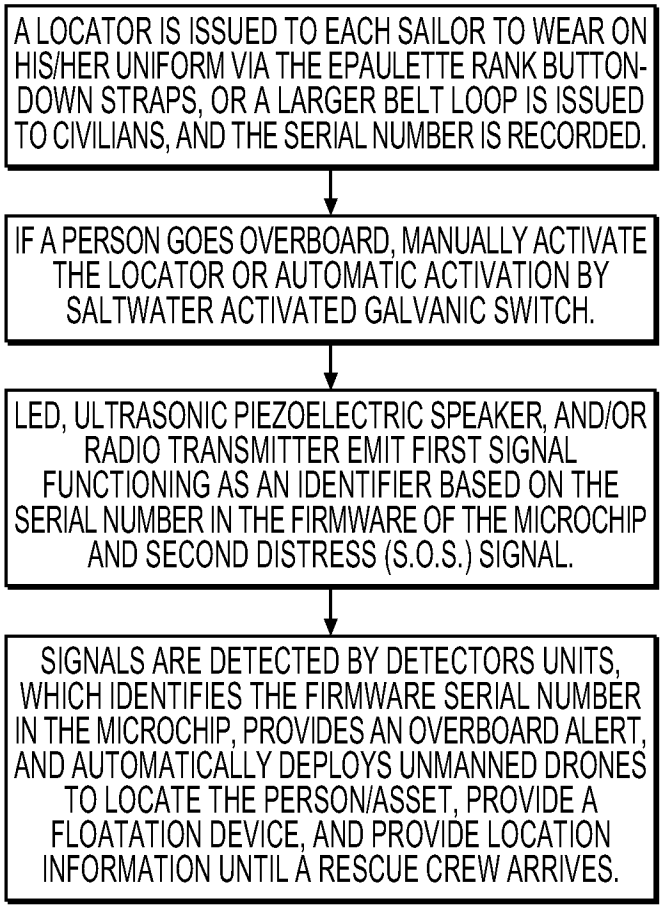
FIG. 3 shows a flowchart of the system operation.

Currently, aerial drones are capable of approximately 15 minutes of flight time and can cover at least 2-5 miles in a sweeping grid pattern. In addition to onboard signal detection and/or data relay from the detector, the aerial drone can be configured to detect a thermal heat signature from the person's head above water (via contrast) and can also detect LED frequency or the flashing pattern from the locator. Once located, as described above the aerial drone can deploy a self-inflating life preserver to sustain sailor until help arrives. If using the underwater drone, the locator can utilize an ultrasonic piezoelectric speaker, which is detectable under water and potentially above water if sound is filtered. In the preferred embodiment, the locator includes a combination of LED, radio, and/or piezoelectric pulse transmitter to enable multiple forms of detection FIG. 3 shows a flowchart of the system operation. A locator is issued to each sailor to wear on his/her uniform via the epaulette rank button-down straps. The serial number of the locator is recorded. Alternately, a larger belt loop is issued to civilians who do not have epaulettes. In the event a person goes overboard, the person manually activates the locator by pulling the plastic tab that separates the battery from the circuit board. Alternately, the device can be activated automatically by a saltwater activated galvanic switch. Once activated, one or more location features are initiated.

For the LED feature, the microchip sends out a series of light pulses through the LED in certain timed intervals. The pulses function primarily as an identifier based on the serial number in the firmware of the microchip, which is used in identification of the overboard person/asset. The pulses can secondarily function as a distress signal, such as by pulsing an S.O.S. signal in Morse code. For the ultrasonic piezoelectric speaker, the microchip sends out a series of audio pulses at a certain frequency and a certain duration. These pulses perform the same function as the LED light by primarily functioning as an identifier based on the serial number in the firmware of the microchip and secondarily as an S.O.S. signal in Morse code, which can be broadcast at 25000 Hz. For the Radio Transmitter, the microchip instructs the radio to transmit a series of radio pulses at a certain frequency and for a certain duration. These pulses perform the same function as the LED light by primarily functioning as an identifier based on the serial number in the firmware of the microchip and secondarily as an S.O.S. signal in Morse code, which can be broadcast at 433 MHz. One or more of these signals are detected by the onboard detectors units, which identifies the firmware serial number in the microchip, provides an overboard alert, and automatically deploys one or more aerial drones and/or underwater drones that will locate the person/asset, provide a floatation device, and provide location information until a rescue crew arrives.

Although the invention has been described in detail with reference to certain preferred embodiments, variations and modifications exist within the spirit and scope of the invention as described and defined in the following claims.

The invention claimed is:

1. A system for locating a person or asset in a body of water comprising:

a locator comprising an attachment mechanism, a microprocessor, a power source, and one or more location sensors;

one or more detector units that receive a signal from said location sensors;

one or more unmanned drones;

wherein, once activated, said one or more location sensors emit a first signal comprising pulses corresponding to a firmware serial number in said microchip and a second signal comprising a distress signal;

wherein said one or more detector units detect said first signal, identify said firmware serial number in said microchip, provide an overboard alert, and deploy said one or more unmanned drones;

wherein said unmanned drone detects a thermal heat signature from said person's head above water.

2. The system of claim 1, wherein said locator is activated by manual activation or by a saltwater activated galvanic switch.

3. The system of claim 1, wherein each of said locators comprise a unique firmware serial number that is assigned to each of said person/asset.

4. The system of claim 1, wherein said one or more location sensors is selected from the group consisting of an LED indicator, an ultrasonic piezoelectric speaker, and a radio transmitter.

5. The system of claim 1, wherein said one or more detector units is located onboard a boat, ship, vessel, or structure.

6. The system of claim 1, wherein said one or more unmanned drones comprise an aerial drone and/or an underwater drone.

7. The system of claim 1, wherein said one or more detector units relay said first signal information to said unmanned drone.

8. The system of claim 1, wherein said one or more unmanned drones receive said first signal from said location sensors and search for said person/asset based on said first signal.

9. The system of claim 1, wherein said one or more unmanned drones comprise rescue equipment comprising an inflatable life preserver or an inflatable life raft and a tether cord that is deployed to said person once located.

10. The system of claim 1, wherein said attachment mechanism comprises an epaulette ring for attachment to an epaulette rank button-down strap on a uniform.

11. A system for locating a person or asset in a body of water comprising:

a locator comprising an epaulette ring for attachment to an epaulette rank button-down strap on a uniform, a microprocessor, a power source, and one or more location sensors selected from the group consisting of an LED indicator, an ultrasonic piezoelectric speaker, and a radio transmitter;

one or more detector units located onboard a boat, ship, vessel, or structure that receive a signal from said location sensors;

one or more unmanned drones comprising an inflatable life preserver or an inflatable life raft and a tether cord;

wherein each of said locators comprise a unique firmware serial number that is assigned to each of said person/asset;

wherein, once activated, said one or more location sensors emit a first signal comprising pulses corresponding to a firmware serial number in said microchip and a second signal comprising a distress signal;

wherein said one or more detector units detect said first signal, identify said firmware serial number in said microchip, provide an overboard alert, and deploy said one or more unmanned drones;

wherein said unmanned drone detects a thermal heat signature from said person's head above water;

wherein said one or more unmanned drones receive said first signal from said location sensors, search for said person/asset based on said first signal, and deploy said inflatable life preserver or said inflatable life raft and said tether cord to said person once located.

12. The system of claim 11, wherein said locator is activated by manual activation or by a saltwater activated galvanic switch.

13. The system of claim 11, wherein said one or more unmanned drones comprise an aerial drone and/or an underwater drone.

14. The system of claim 11, wherein said one or more detector units relay said first signal information to said unmanned drone.

* * * * *